United States Patent [19]

Wendel

[11] 4,449,843

[45] May 22, 1984

[54] OCTA HUB

[75] Inventor: Wendel R. Wendel, Plainview, N.Y.

[73] Assignee: Space Structures International Corp., Plainview, N.Y.

[21] Appl. No.: 325,802

[22] Filed: Nov. 30, 1981

[51] Int. Cl.[3] ..... F16B 7/00

[52] U.S. Cl. ..... 403/173; 52/81

[58] Field of Search ..... 403/170, 171, 172, 176, 403/174, 175, 173, 178, 177, 205, 403, 217; 52/81

[56] References Cited

U.S. PATENT DOCUMENTS 3,688,461 9/1972 Rensch ..... 403/174 X 3,861,107 1/1975 Papayoti ..... 403/171 X

FOREIGN PATENT DOCUMENTS 220024 10/1968 U.S.S.R. ..... 403/173

*Primary Examiner*—Andrew V. Kundrat

*Attorney, Agent, or Firm*—Kane, Dalsimer, Kane, Sullivan & Kurucz

[57] ABSTRACT

A connection for structural members is provided including a plurality of hub components each having projecting ears for receiving the end of a structural member, with the components being rotated to define angles between the respective ears of adjacent hub components, and with the hub components being precompressed together by bolt means.

8 Claims, 8 Drawing Figures

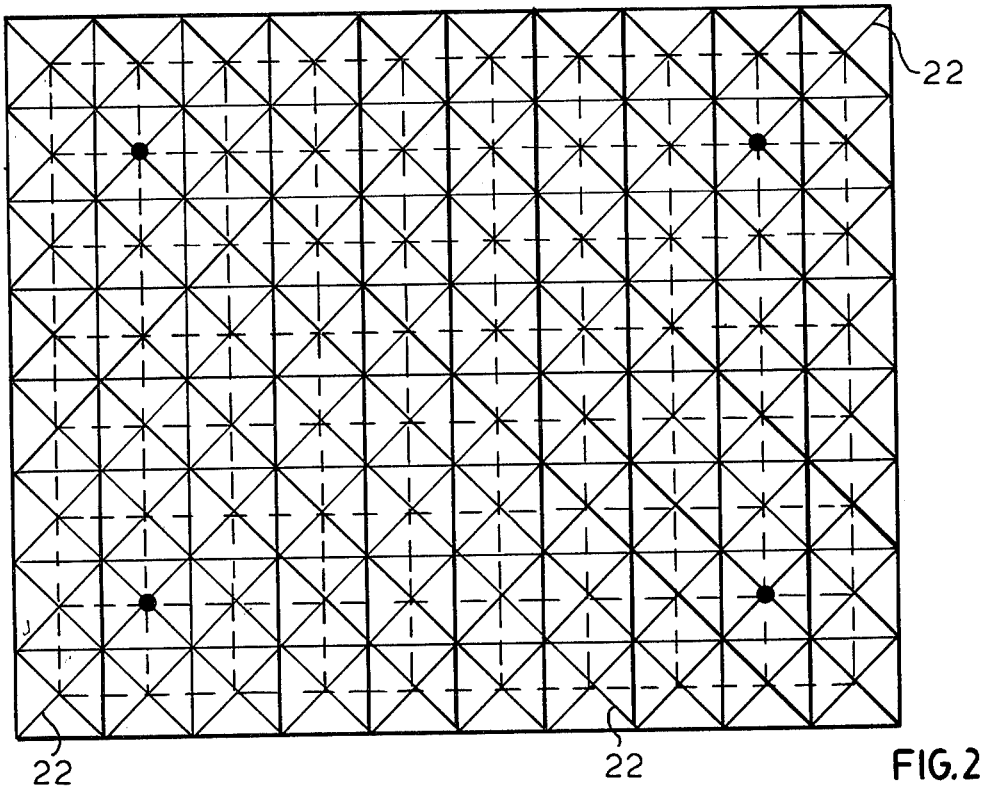
FIG.2
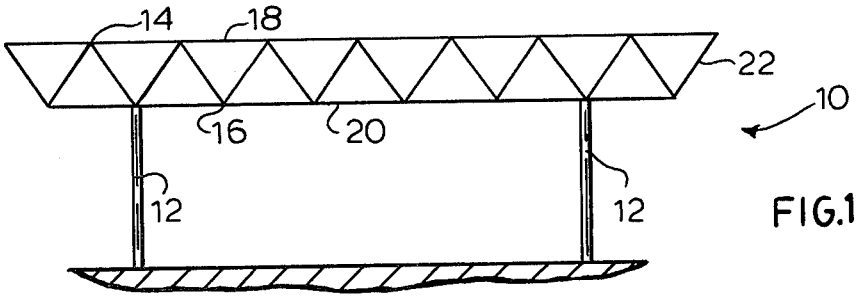
FIG.1
FIG.8
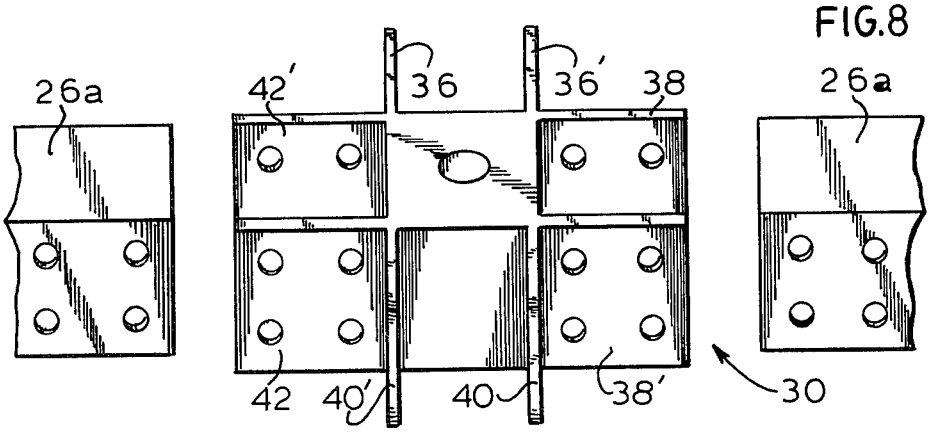

FIG. 3
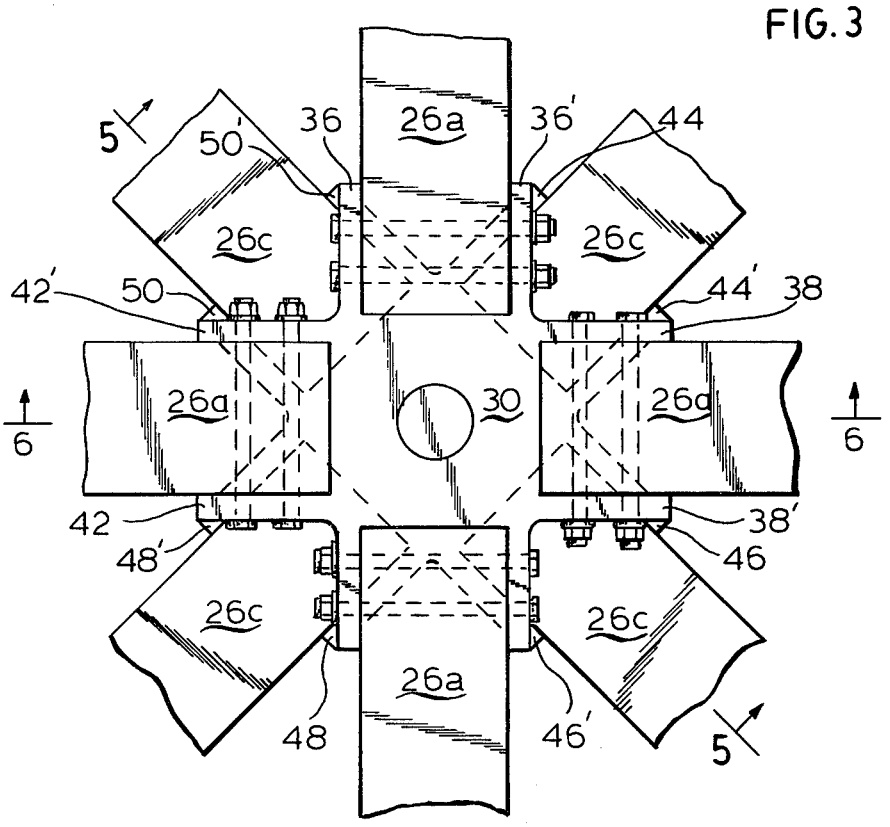
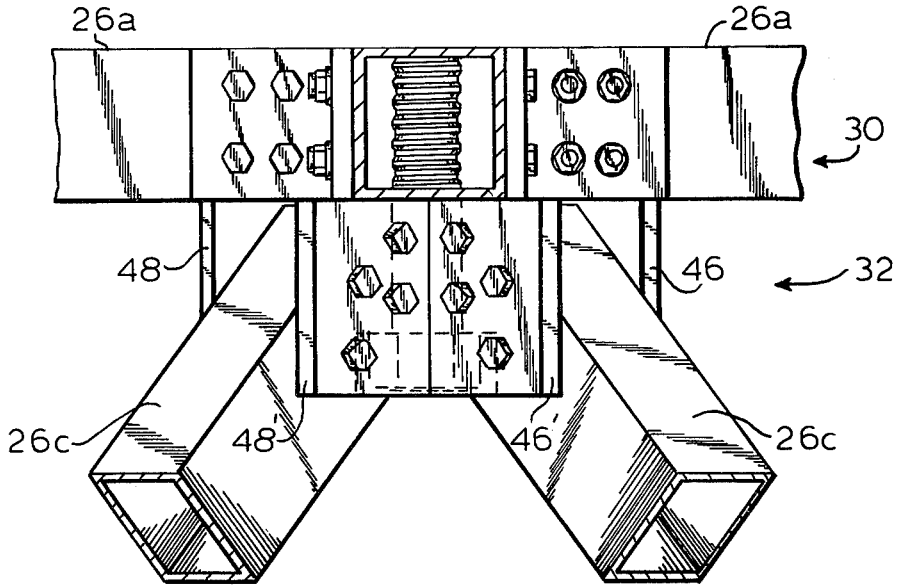
FIG. 4

FIG. 6
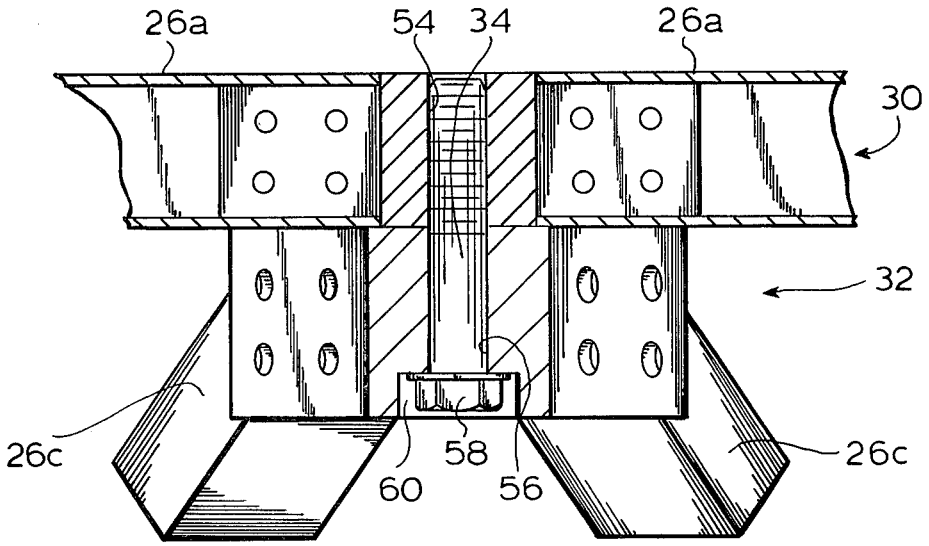
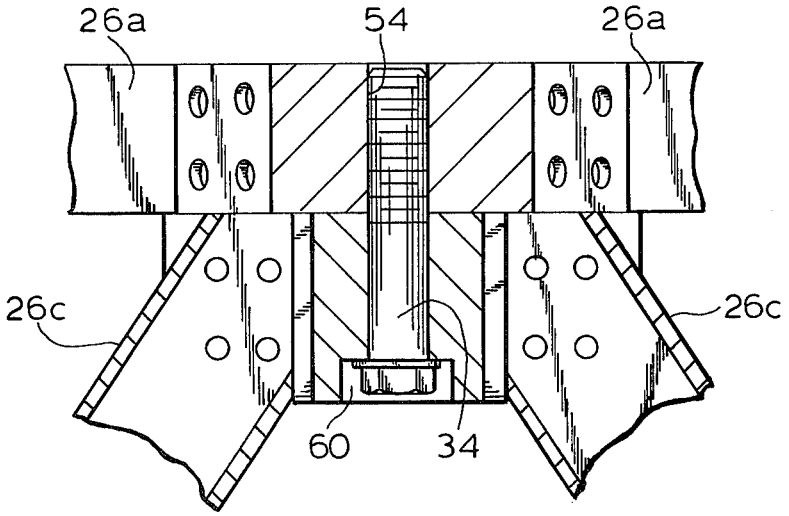
FIG. 5

OCTA HUB

BACKGROUND OF THE INVENTION

Structural configurations known as space frames wherein strut members are joined at ends in three dimensional arrays are known in the art. Satisfactory strut connecting members, known as hubs, are key members in such a structure. To be useful such a hub must be relatively inexpensive and easy to work with as well as having structural integrity.

SUMMARY OF THE INVENTION

The hub, described and claimed herein, is an economical, versatile configuration applicable to all space truss systems. Two hub and three hub components are presstressed into a structural unit to accomodate typical 4 chords and typical 4 diagonals without joint eccentricity.

Essentially, the hub of this invention consists of two or three components precompressed together by a high-strength bolt to form a structural unit capable of transferring axial and shear loads from truss members via direct and bending action.

The hub can be fabricated from aluminum extrusions and is, therefore, intrinsically economical. The other components are precompressed together using a high-strength aluminum stainless or structural steel center bolt pretensioned by a precalibrated torque wrench.

The typical hub of this invention consists of one component with typically four orthogonal sets of ears which bolt to top or bottom chord members, and a second component rotated 45° from the chord axes which bolts to the diagonals. The components are essentially identical in configuration however the component which bolts to the diagonals is generally 1½ to 2 times as deep as the other component; this additional depth eliminates joint eccentricities, provides sufficient material for bolting the truss diagonals and reduces stresses in the ears as well.

For those types of space trusses where the diagonals are parallel to the bottom chords or to both the top and bottom chords only a single component without a center bolt may be required.

In the typical hub of this invention, the component which bolts to the truss diagonals is rotated 45° from the component which bolts to the truss chords. In theory therefor the resultants of the diagonal loads are in the same planes as the chord loads and equal to 2 times the load in each diagonal.

Hub equilibrium is maintained, as shown below, by bending in the precompressed solid portion of the hub. All member forces meet at a single point and there are no joint eccentricities. High chord loads may be accommodated by adding splice plates between the chord members as desired.

The structural integrity of the hub is accomplished by the transfer of precompression, shear and bending stresses across the interface between the two hub components. The pretensioned center bolt provides precompression on the interface area.

Prestressing serves a dual purpose. First, it permits the development of a bending moment across the hub interfaces outer fiber bending stresses. Second, the prestress accommodates a horizontal shear transfer across the interface equal to the prestress force times the coefficient of friction for aluminum.

DESCRIPTION OF THE FIGURES

FIG. 1 is an elevation of a typical space frame structure utilizing a hub constructed in accordance with this invention;

FIG. 2 is a top plan view of such a structure as that shown in FIG. 1;

FIG. 3 is a partially sectional plan view of the hub of this invention with strut ends shown attached thereto;

FIG. 4 is a partially sectional elevation of the hub shown in FIG. 3;

FIG. 5 is a partially sectional view taken along the line 5—5 in the direction of the arrows in FIG. 3;

FIG. 6 is a partially sectional view taken along the line 6—6 in the direction of the arrows in FIG. 3;

FIG. 8 is an exploded perspective segmentary view of the horizontal component of the hub.

DESCRIPTION OF THE PREFERRED EMBODIMENT

Figure 7:
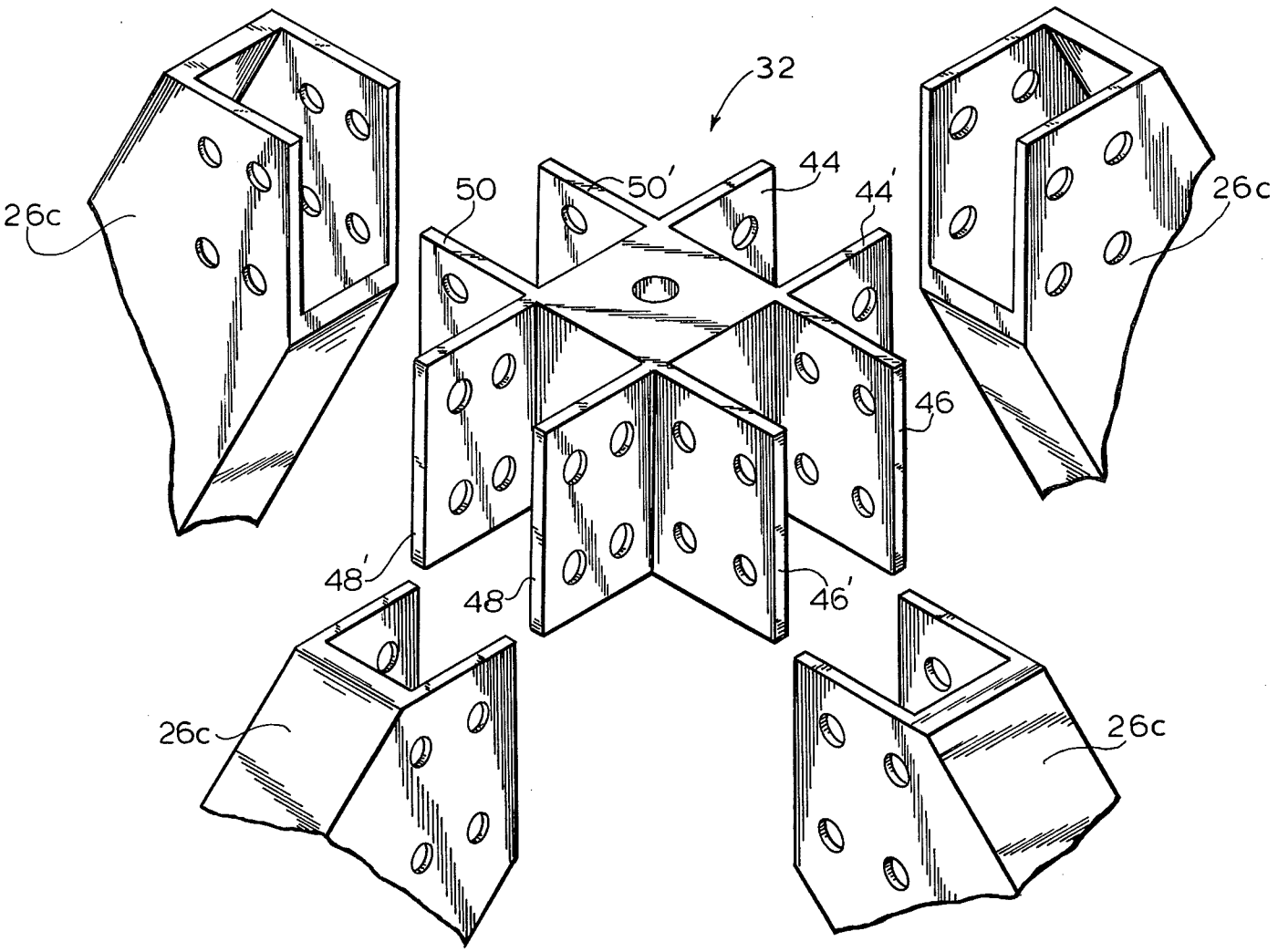
FIG. 7 is an exploded perspective segmentary view of the diagonal component of the hub.

In FIG. 1 a typical space frame structure is shown in the form of a double grid system 10 supported on columns 12. Upper and lower transverse struts are indicated by the numerals 14 and 16 respectively while the upper and lower lengthwise struts are respectively indicated by the numerals 18 and 20. The upper struts are connected to the lower struts by web members 22 and all struts are connected at ends by the hub of this invention which is illustrated in the remaining FIGS. and indicated therein by the numeral 24 wherein all struts and webs connected thereto are indicated generally by the numeral 26.

The hub of this invention consists essentially of a component 30 and a component 32, each of which can be fabricated from aluminum extrusions cut to size and these components are held together by a high strength bolt 34 which can be fabricated of steel or aluminum, to form a structural unit capable of transferring axial and shear loads from truss members by direct and bending action.

Since the hub can be fabricated from aluminum extrusions it is intrinsically economical. The two components 30 and 32 are precompressed together using high-strength stainless steel, structural steel or aluminum center bolt 34 pretensioned by a precalibrated torque wrench.

As shown in the Figs components 30 and 32 are essentially identical in configuration. Each has four orthoganol sets of ears. The top component 30 is referred to herein as the horizontal component and has four identical by the numerals 36 and 36', 38 and 38', 40 and 40' and 42 and 42'. These bolt to the top or bottom strut or chord members identified respectively herein by the numerals **26*a* and 26*b*. The second component 30 is referred to as the bottom or diagonal component. It also has four sets of ears identified herein by the numerals 44 and 44', 46 and 46', 48 and 48', and 50 and 50'. These bolt to the diagonals identified herein by the numeral 26*c*. The members 30 and 32 are cut from extrusions and substantially identical in configuration however, the diagonal component is generally 1½ to 2 times as deep as the other component. In the typical hub of this invention the component which bolts to the truss diagonals viz component 32, is rotated 45° from the component 30**.

As seen in the Figs hub component 30 is provided with a central threaded hole 54 which receives the threaded end of bolt 34 which passes through unthreaded hole 56 in hub component 32. Head 58 of bolt 34 being in recess 60 in hub component 32. Hence the two hub components are assembled.

The truss members 26*a* are bolted to hub component 30 and the truss members 26*c* are bolted to hub component 32 by high strength bolts to predetermined torque values.

The advantages to the present invention are many however one of the most significant is that of low cost because of the capability of extruding the hub components in long lengths and cutting to size as well as the minimal use of material to fabricate the hub. The pretension center bolt used to join the two sections of hub together provides good diagonal load capabilities.

The method of attaching strut to hub, namely through use of parallel flanges enables the use of strut members with similar nominal size but with varying wall thickness and load capabilities to optimize the amount of material use in the over-all space frame and allow for many geometric configurations. Various size hubs can be achieved and the modular size can be easily varied to accomodate design requirements, the depth of truss can be easily varied by the angle of the diagonal struts. In summary a versatile and economical hub for various structural configuration is presented herein.

I claim:

1. A connection for structural members including a plurality of hub components each of which has projecting ears constructed and arranged to receive the end of a structural member, said hub components being rotated to define angles between the respective ears of adjacent hub components, said hub components being precompressed together by bolt means to form a structural unit capable of transferring axial and shear loads from said structural members attached to said ears.

2. A connection for structural members in accordance with claim 1 including a first hub component comprising a central portion with a plurality of pairs of projecting ears, each of which is constructed and arranged to symmetrically receive the end of one of said structural members between the ears of said pair.

3. A connection in accordance with claim 1 in which first and second hub components are provided, each of which comprising a central portion and a plurality of pairs of projecting ears.

4. A connection in accordance with claim 3 in which said first and second hub components are precompressed together by a bolt to form a quasimonolithic structural unit capable of transferring axial and shear loads in a direct path from said structural members to said ears.

5. A connection in accordance with claim 4 in which said hub components are extrusions.

6. A connection in accordance with claim 4 in which said first and second hub components are rotated forty-five degrees with respect to each other.

7. A connection for structural members including first and second hub components each respectively comprising a central portion with a plurality of pairs of projecting ears, each of said pairs of ears being constructed and arranged to receive the end of one of said structural members between the ears of said pair and in which said first and second hub components are rotated forty-five degrees with respect to each other, said first and second hub components being precompressed together by a bolt to form a structural unit capable of transferring axial and shear loads from said structural members attached to said ears and in which said fist and second hub components are substantially identical in configuration however said second hub component is of greater depth than said first hub component whereby joint eccentricities are eliminated and sufficient material is provided for bolting the structural members while reducing stress in said ears.

8. A connection in accordance with claim 1 in which the ears of each pair are parallel and provide a direct path for the load from the structural member to the ears.

* * * * *